US006023936A

United States Patent [19]

Choi

[11] Patent Number: 6,023,936

[45] Date of Patent: Feb. 15, 2000

[54] INDOOR UNIT OF AN AIR CONDITIONER

[75] Inventor: Soung-Hyun Choi, Incheon, Rep. of Korea

[73] Assignee: Daewoo Electronics Co., Ltd., Seoul, Rep. of Korea

[21] Appl. No.: 09/121,310

[22] Filed: Jul. 23, 1998

[30] Foreign Application Priority Data

Jul. 31, 1997 [KR] Rep. of Korea ..... P 97-36378

[51] Int. Cl.[7] ..... F25D 21/14

[52] U.S. Cl. ..... 62/285

[58] Field of Search ..... 62/262, 285, 298

[56] References Cited

U.S. PATENT DOCUMENTS

| | | | |
|---|---|---|---|
| 3,756,039 | 9/1973 | Riello | 62/262 |
| 5,392,613 | 2/1995 | Bolton et al. | 62/262 |
| 5,638,692 | 6/1997 | Aizawa et al. | 62/262 |

FOREIGN PATENT DOCUMENTS

| | | |
|---|---|---|
| 0 769 660 | 4/1997 | European Pat. Off. . |
| 769660 | 4/1997 | European Pat. Off. . |
| 7-027361 | 1/1995 | Japan . |
| 8-145395 | 6/1996 | Japan . |

*Primary Examiner*—William Doerrler
*Attorney, Agent, or Firm*—Pillsbury Madison & Sutro LLP

[57] ABSTRACT

An indoor unit of an air conditioner which has a simple construction and can be easily assembled. The indoor unit has a housing including a front frame and a rear frame coupled to the front frame, an evaporator installed in the housing for generating a chilled air, a blow fan for blowing the chilled air generated by the evaporator, a motor for rotating the blow fan, a drain pan for receiving and discharging a defrosted water dropped from the evaporator, ribs which are coupled with the drain pan for rotatably fixing the blow fan to the rear frame, and a hook assembly for detachably securing the drain pan to the rear frame. The indoor unit does not require a separate device for securing the blow fan and the drain pan to the rear wall of the housing, so the number of elements and assembling steps are reduced.

10 Claims, 4 Drawing Sheets

INDOOR UNIT OF AN AIR CONDITIONER

BACKGROUND OF THE INVENTION

1. Field of the Invention

The present invention relates to an air conditioner, and more particularly to an indoor unit of an air conditioner which is simply constructed and can be easily assembled.

2. Description of the Prior Art

In general, an air conditioner is an appliance for satisfying a desire of human beings to live in a more comfortable environment, and is used for controlling and maintaining the temperature of a room.

The air conditioner includes a compressor for compressing an evaporated refrigerant, a condenser for absorbing a heat from a compressed refrigerant and discharging the heat to an atmosphere so that the refrigerant can be liquified, an expansion valve for reducing a pressure of the liquified refrigerant and expanding the refrigerant, and an evaporator which evaporates the refrigerant thereby absorbing a heat from a periphery thereof. Those elements are connected to each other by means of pipes through which a refrigerant passes. The phase of the refrigerant is changed while repeatedly circulating through the pipes, thereby absorbing the heat from the atmosphere or discharging the heat to the atmosphere.

Generally, the air conditioner is divided into an indoor unit and an outdoor unit. The compressor, the condenser, and the expansion valve are accommodated in the outdoor unit, and the evaporator and a blow fan are accommodated in the indoor unit.

FIG. 4 shows an indoor unit 500 of a conventional air conditioner. As shown in FIG. 4, indoor unit 500 of the conventional air conditioner has a housing 510 including a front frame 300 and a rear frame 400 coupled to front frame 300.

Provided in housing 510 are an evaporator (not shown) for generating a chilled air, a blow fan 470 for blowing the chilled air towards the room, a motor 460 for rotating blow fan 470, and a drain pan 450 for receiving and discharging a defrost water dropped from the evaporator.

In order to allow those elements to be installed in housing 510, rear frame 400 is formed with an evaporator seat 410, a recess 420 for receiving blow fan 470, and a motor seat 430.

Evaporator seat 410 is formed at an inner upper portion of rear frame 400 and recess 420 is formed below evaporator seat 410. In addition, motor seat 430 is positioned on the right of recess 420 and a connection member 440 having a hollow portion 441 therein is provided between motor seat 430 and recess 420. Recess 420 has first and second coupling holes 422 and 424 at side walls thereof for coupling blow fan 470. Second coupling hole 424 is communicated with hollow portion 441 of connection member 440.

Blow fan 470 has a center shaft 472. A first end of center shaft 472 is rotatably coupled to bearing 476 and a second end of center shaft 472 is formed with an insert hole 474 into which a motor shaft 462 of motor 460 is inserted. In addition, first and second fixing plate 452 and 453 are upwardly protruded at upper portions of both side ends of drain pan 450, respectively. First and second fixing plate 452 and 453 have first and second apertures 454 and 455, respectively.

Conventional indoor unit 500 having the above construction is assembled as follows.

Firstly, motor 460 is installed in motor seat 430 in such a manner that motor shaft 462 extends towards hollow portion 441 of connection member 440. Then, blow fan 470 is received in recess 420. At this time, the second end of center shaft 472 of blow fan 470 extends into hollow portion 441 of connection member 440 passing through second coupling hole 424 so that motor shaft 462 is inserted into insert hole 474 of center shaft 472. In addition, the first end of center shaft 472, which is coupled with bearing 476, is inserted into first coupling hole 422 formed at the side wall of recess 420.

Next, the user puts an upper thruhole 484 of a first bracket 480 on a first screw hole 442 formed at a front upper portion of connection member 440 and secures an upper portion of first bracket 480 to connection member 440 by using a first screw 482. In addition, the user puts a lower thruhole 486 of first bracket 480 on a second screw hole 444 formed at a front lower portion of connection member 440 and puts first aperture 454 of first fixing plate 452 on lower thruhole 486 of first bracket 480. In this state, the user secures first fixing plate 452 and the lower end of first bracket 480 to connection member 440 by using a second screw 456. Accordingly, the second end of center shaft 472 of blow fan 470 and motor shaft 462 coupled to the second end of center shaft 472 are supported in hollow portion 441 of connection member 440 by first bracket 480.

Then, the user puts an upper thruhole 492 of a second bracket 490 on a third screw hole 426 formed at an inner wall of rear frame 400 and secures an upper portion of second bracket 490 to the inner wall of rear frame 400 by using a third screw 496. In addition, the user puts a lower thruhole 494 of second bracket 490 on a fourth screw hole 428 formed below third screw hole 426, and puts second aperture 455 of second fixing plate 453 on lower thruhole 494 of second bracket 490. In this state, the user secures second fixing plate 453 and the lower end of second bracket 490 to the inner wall of rear frame 400 by using a fourth screw 457. Accordingly, the first end of center shaft 472 of blow fan 470 is stably supported in first coupling hole 422.

Finally, front frame 300 is coupled to rear frame 400 so that indoor unit 500 is completed.

However, indoor unit 500 requires first and second brackets 480 and 490 for fixing blow fan 470 and drain pan 450 to rear frame 400. In addition, first and second brackets 480 and 490 must be fixed to rear frame 400 by using screws. For these reasons, many elements and assembling steps are required to manufacture indoor unit 500.

SUMMARY OF THE INVENTION

The present invention has been made to overcome the above described problem of the prior art, and accordingly, it is an object of the present invention to provide an indoor unit of an air conditioner which has a simple construction and can be easily assembled.

To accomplish the above object, the present invention provides an indoor unit of an air conditioner comprising:

- a housing including a front frame and a rear frame coupled to the front frame;
- an evaporator installed in the housing for generating a chilled air;
- a blow fan for blowing the chilled air generated by the evaporator, the blow fan having a center shaft;
- a motor for rotating the blow fan;
- a first means for receiving and discharging a defrosted water dropped from the evaporator and for rotatably attaching the blow fan to the rear frame; and
- a second means for detachably securing the first means to the rear frame.

According to the preferred embodiment of the present invention, the first means includes a first rib integrally formed at an upper portion of an inner wall of the rear frame, a second rib which is integrally formed at the upper portion of an inner wall of the rear frame and is transversely spaced by a predetermined distance apart from the first rib, and a drain pan which has a defrosted water container at a lower portion thereof and is integrally formed at both sides of an upper end thereof with first and second fixing plates which are inserted into the first and second ribs.

The second means includes at least one hook hole formed at a lower portion of the inner wall of the rear frame, and at least one hook which is provided at a lower portion of a front surface of the drain pan so as to be inserted into the hook hole.

The indoor unit of the present invention does not require a separate device for securing the blow fan and the drain pan to the rear frame of the housing, so the number of elements and assembling steps are reduced.

BRIEF DESCRIPTION OF THE DRAWINGS

The above object and other advantages of the present invention will become more apparent by describing in detail the preferred embodiment thereof with reference to the attached drawings, in which.

DESCRIPTION OF THE PREFERRED EMBODIMENT

Hereinafter, a preferred embodiment of the present invention will be described in detail with reference to the accompanying drawings.

Figure 1:
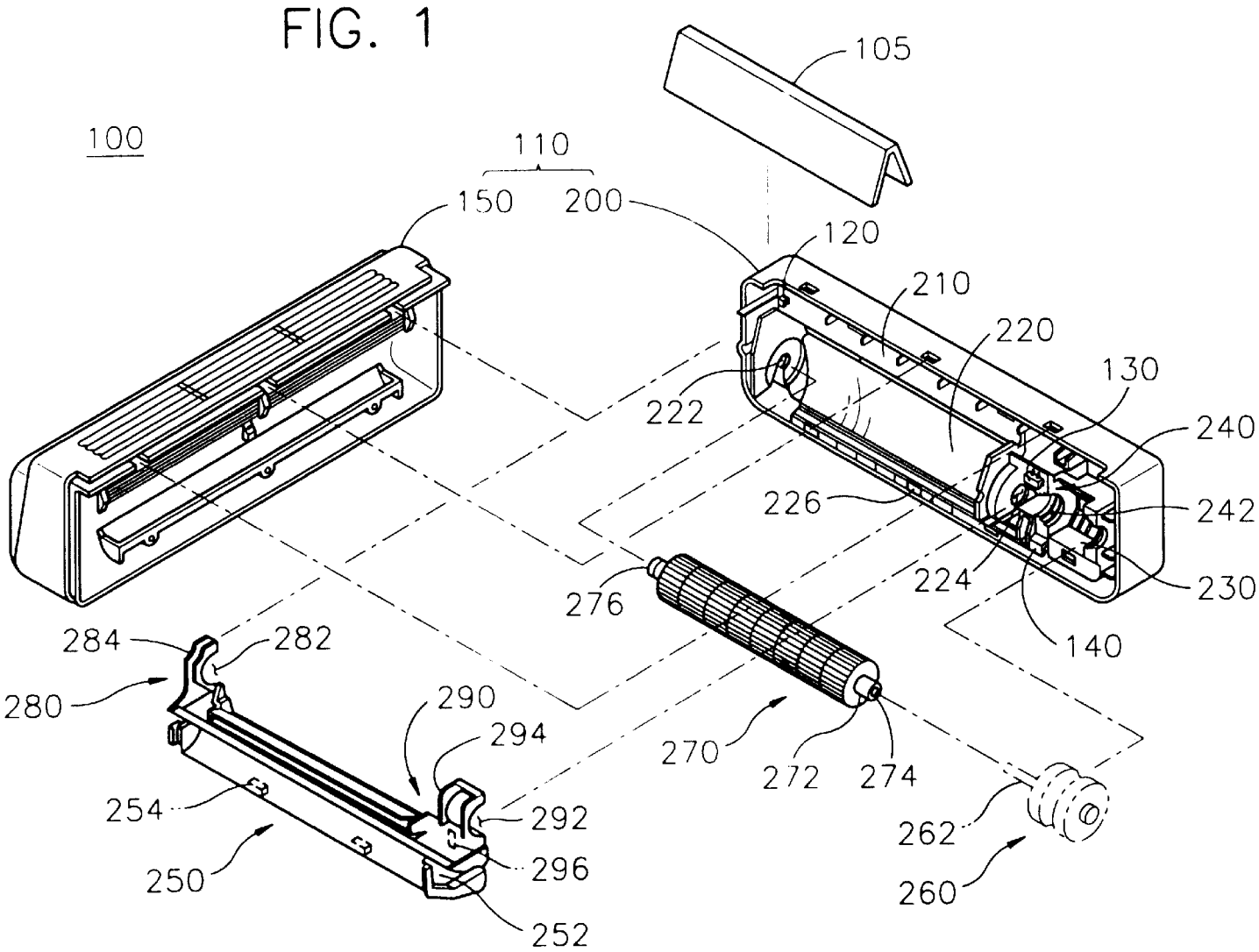
FIG. 1 is an exploded perspective view showing an indoor unit of an air conditioner according to one embodiment of the present invention.

FIG. 1 shows an indoor unit 100 of an air conditioner according to the preferred embodiment of the present invention. As shown in FIG. 1, indoor unit 100 of the present invention has a housing 110 including a front frame 150 and a rear frame 200 coupled to front frame 150.

Provided in housing 110 are an evaporator 105 for generating a chilled air, a blow fan 270 for blowing the chilled air towards the room, a motor 260 for rotating blow fan 270 and a drain pan 250 for receiving and discharging a defrosted water dropped from evaporator 105.

In order to allow those elements to be installed in housing 110, rear frame 200 is formed with an evaporator seat 210, a recess 220 for receiving blow fan 270 and a motor seat 230.

Evaporator seat 210 is formed at an inner upper portion of rear frame 200 and recess 220 is formed below evaporator seat 210. In addition, motor seat 230 is positioned on the right of recess 220 and a connection member 240 having a hollow portion 241 therein is provided between motor seat 230 and recess 220. Recess 220 has first and second coupling holes 222 and 224 at side walls thereof for coupling blow fan 270. Second coupling hole 224 is communicated with hollow portion 241 of connection member 240.

Blow fan 270 has a center shaft 272. A first end of center shaft 272 is rotatably coupled to bearing 276 and a second end of center shaft 272 is formed with an insert hole 274 into which a motor shaft 262 of motor 260 is inserted.

Drain pan 250 has a defrosted water container 252 at a lower portion thereof and is integrally formed at both sides of an upper end thereof with first and second fixing plate 280 and 290 which are upwardly protruded, respectively. The length of second fixing plate 290 is shorter than the length of first fixing plate 280.

First fixing plate 280 is formed at a predetermined portion thereof with a first semi-circular groove 282 for supporting a first end of center shaft 272 of blow fan 270 and second fixing plate 290 is formed at a predetermined portion thereof with a second semi-circular groove 292 for supporting a second end of center shaft 272 of blow fan 270. In addition, first fixing plate 280 is provided at a rear surface thereof with a pair of first guide plates 284 facing each other, and second fixing plate 290 is provided at a rear surface thereof with a pair of second guide plates 294 facing each other.

Figure 2:
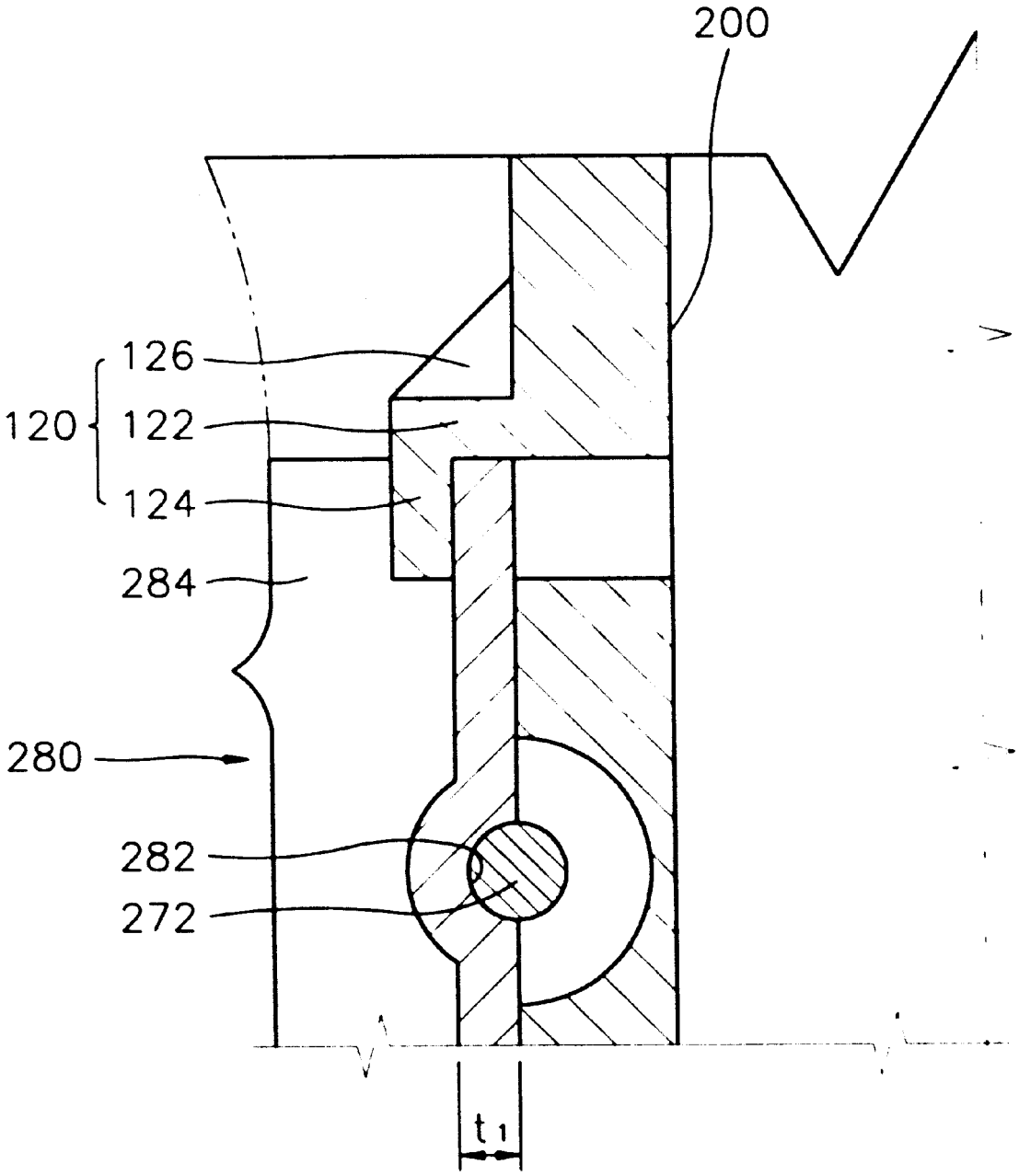
FIG. 2 is a cross-sectional view showing a drain pan engaged with a first rib.

A first rib 120, which is engaged with first fixing plate 280 of drain pan 250, is integrally formed at an upper portion of an inner wall of rear frame 200. As shown in FIG. 2 in detail, first rib 120 includes a first horizontal portion 122 integrally formed with the inner wall of rear frame 200, a first vertical portion 124 which is integrally formed with a free end of first horizontal portion 122 and downwardly extends in parallel to the inner wall of rear frame 200, and reinforce member 126 provided on the upper surface of first horizontal portion 122.

A distance between the inner wall of rear frame 200 and first vertical portion 124 is identical to a thickness $t_1$ of first fixing plate 280, so first fixing plate 280 is press-fitted between the inner wall of rear frame 200 and first vertical portion 124. In addition, a distance between the pair of first guide plates 284 is identical to a width of first vertical portion 124. Accordingly, when first fixing plate 280 is engaged with first rib 120, first vertical portion 124 is positioned between the pair of first guide plates 284, so the first fixing plate 280 is prevented from separating from first rib 120.

Referring again to FIG. 1, a second rib 130, which is engaged with second fixing plate 290 of drain pan 250, is integrally formed at the upper portion of the inner wall of rear frame 200. In order to allow first and second fixing plates 280 and 290 to be engaged with first and second ribs 120 and 130, second rib 130 is transversely spaced by a predetermined distance apart from first rib 120 and is disposed below first rib 120.

Figure 3:
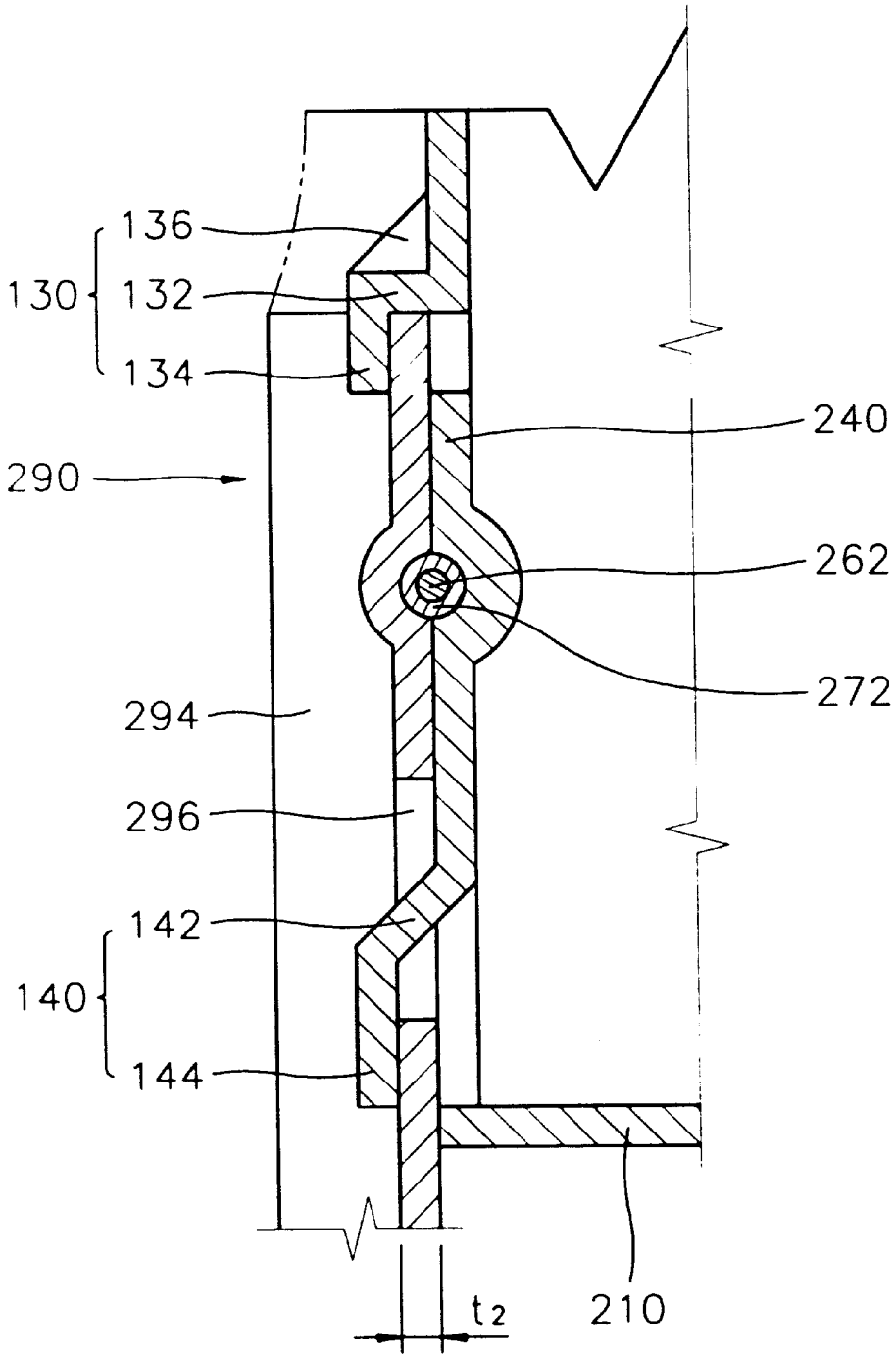
FIG. 3 is a cross-sectional view showing a drain pan engaged with second and third ribs.
Figure 4:
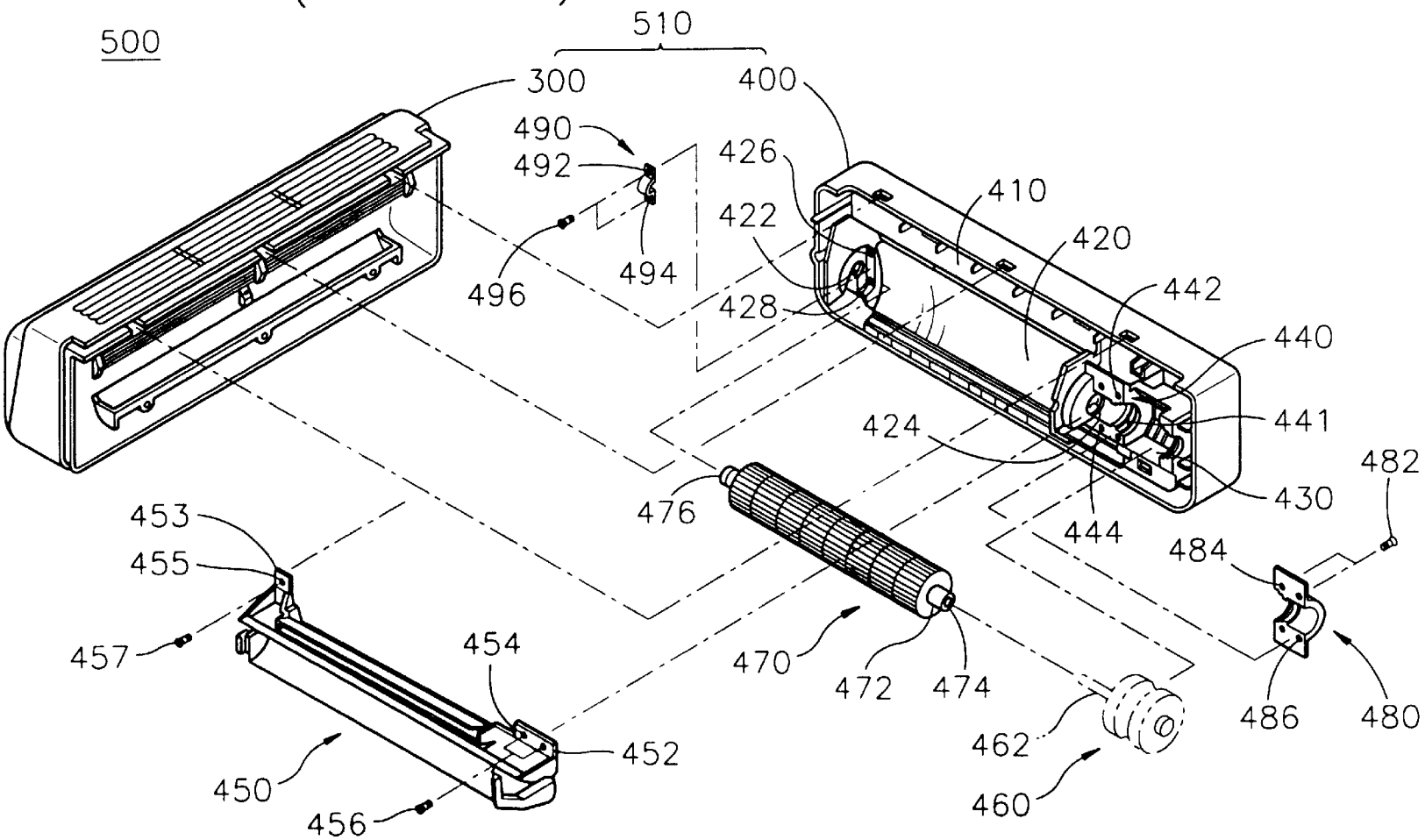
FIG. 4 (PRIOR ART)
FIG. 4 is an exploded perspective view showing a conventional indoor unit of an air conditioner.

As shown in FIG. 3 in detail, second rib 130 includes a second horizontal portion 132 integrally formed with the upper portion of the front surface of connection member 240, a second vertical portion 134 which is integrally formed with a free end of second horizontal portion 132 and downwardly extends in parallel to the inner wall of rear frame 200 and reinforce member 136 provided on the upper surface of second horizontal portion 132.

A distance between the front surface of connection member 240 and second vertical portion 124 is identical to a thickness $t_2$ of second fixing plate 290, so second fixing plate 280 is press-fitted between the front surface of connection member 240 and second vertical portion 134. In addition, a distance between the pair of second guide plates 294 is identical to a width of second vertical portion 134. Accordingly, when second fixing plate 290 is engaged with second rib 130, second vertical portion 134 is positioned between the pair of second guide plates 294, so the second fixing plate 290 is prevented from separating from second rib 130.

On the other hand, a third rib 140 is integrally formed with a lower portion of the front surface of connection member 140. Third rib 140 is inserted into a rectangular opening 296 formed at a lower portion of second fixing plate 290 so that drain pan 250 is prevented from separating from rear frame 200.

As shown in FIG. 3 in detail, third rib 140 includes an inclined portion 144 which is integrally formed with the lower portion of the front surface of connection member 140 and a vertical portion 144 which is integrally formed with a free end of inclined portion 144 and downwardly extends in parallel to the inner wall of rear frame 200. Vertical portion 144 of third rib 140 is inserted into rectangular opening 296 and makes contact with a rear surface of second fixing plate 290 when drain pan 250 is assembled with rear frame 200.

Referring again to FIG. 1, at least one hook hole 226 is formed at a lower portion of the inner wall of rear frame 200, and at least one hook 254 is provided at a lower portion of a front surface of drain pan 250 so as to be inserted into hook hole 226. Accordingly, drain pan 250 can be securely coupled to rear frame 200 while supporting blow fan 270.

Indoor unit 100 having the above construction is assembled as follows.

Firstly, motor 260 is installed in motor seat 230 in such a manner that motor shaft 262 extends towards hollow portion 241 of connection member 240. Then, blow fan 270 is received in recess 220. At this time, the second end of center shaft 272 of blow fan 270 extends into hollow portion 241 of connection member 240 passing through second coupling hole 224 so that motor shaft 262 is inserted into insert hole 274 of center shaft 272. In addition, the first end of center shaft 272, which is coupled with bearing 276, is inserted into first coupling hole 222 formed at the side wall of recess 220.

Next, after partially inserting first fixing plate 280 of drain pan 250 into first rib 120, second fixing plate 290 of drain pan 250 is partially inserted into second rib 230. In this state, vertical portion 144 of third rib 140 faces rectangular opening 296 formed at second fixing plate 290.

Then, the user pushes drain pan 250 towards rear frame 200 so that vertical portion 144 of third rib 140 is inserted into rectangular opening 286. After that, the user upwardly moves drain pan 250 in such a manner that first and second fixing plates 180 and 190 are press-fitted into first and second ribs 120 and 130, respectively. In this state, first and second ends of center shaft 272 of blow fan 270 are supported by first and second semi-circular grooves 282 and 292 formed at first and second fixing plates 280 and 290, respectively.

Next, drain pan 250 is fixed to rear frame 200 by inserting hook 254 provided at the lower portion of drain pan 250 into hook hole 226 formed at the lower portion of rear frame 200.

Finally, front frame 150 is coupled to rear frame 200 so that indoor unit 100 is completed. In this manner, blow fan 270 and drain pan 250 can be stably secured to rear frame 200 of housing 110 without using a fixing device such as screws or brackets.

As described above, the indoor unit of the present invention does not require the fixing device for securing the blow fan and drain pan to the rear frame of the housing, so the number of elements and assembling steps are reduced.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. An indoor unit of an air conditioner comprising:

a housing including a front frame and a rear frame coupled to the front frame;

an evaporator installed in the housing for generating a chilled air;

a blow fan for blowing the chilled air generated by the evaporator, the blow fan having a center shaft;

a motor for rotating the blow fan;

a first rib integrally formed at an upper portion of an inner wall of the rear frame;

a second rib integrally formed at the upper portion of the inner wall of the rear frame and transversely spaced by a predetermined distance apart from the first rib, the second rib being disposed below the first rib;

a drain pan having a defrosted water container at a lower portion thereof and integrally formed at both sides of an upper end thereof with first and second fixing plates which are upwardly protruded and are inserted into the first and second ribs, respectively; and at least one hook which is provided at a lower portion of a front surface of the drain pan so as to be inserted into at least one hook hole formed at a lower portion of the inner wall of the rear frame.

2. The indoor unit as claimed in claim 1, wherein the first fixing plate is formed at a predetermined portion thereof with a first semi-circular groove for supporting a first end of the center shaft of the blow fan and the second fixing plate is formed at a predetermined portion thereof with a second semi-circular groove for supporting a second end, which is opposite to the second end, of the center shaft of the blow fan.

3. The indoor unit as claimed in claim 2, further comprising a third rib which is integrally formed with the inner wall of the rear frame and is disposed below the second rib, a rectangular opening being formed at a lower portion of the second fixing plate.

4. The indoor unit as claimed in claim 3, wherein the third rib includes an inclined portion which is integrally formed with the inner wall of the rear frame and a vertical portion which is integrally formed with a free end of the inclined portion and downwardly extends in parallel to the inner wall of the rear frame, the vertical portion of the third rib being inserted into the rectangular opening and making contact with a rear surface of the second fixing plate when the drain pan is assembled with the rear frame.

5. The indoor unit as claimed in claim 2, wherein the first rib includes a first horizontal portion integrally formed with the inner wall of the rear frame and a first vertical portion which is integrally formed with a free end of the first horizontal portion and downwardly extends in parallel to the inner wall of the rear frame, and the second rib includes a second horizontal portion integrally formed with the inner wall of the rear frame and a second vertical portion which is integrally formed with a free end of the second horizontal portion and downwardly extends in parallel to the inner wall of the rear frame, the first fixing plate being inserted between the first vertical portion and the inner wall of the rear frame, the second fixing plate being inserted between the second vertical portion and the inner wall of the rear frame.

6. The indoor unit as claimed in claim 5, wherein a distance between the inner wall of the rear frame and the first vertical portion is identical to a thickness of the first fixing plate, and a distance between the inner wall of the rear frame and the second vertical portion is identical to a thickness of the second fixing plate.

7. The indoor unit as claimed in claim 5, wherein the first fixing plate is provided at a rear surface thereof with a pair of first guide plates, which face to each other, for preventing the first fixing plate engaged with the first rib from separating from the first rib, and the second fixing plate is provided at a rear surface thereof with a pair of second guide plates, which face to each other, for preventing the second fixing plate engaged with the second rib from separating from the second rib.

8. The indoor unit as claimed in claim 7, wherein a distance between the pair of first guide plates is identical to a width of the first vertical portion and a distance between the pair of second guide plates is identical to a width of the second vertical portion.

9. The indoor unit as claimed in claim 5, wherein the rear frame is integrally formed with a recess for receiving the blow fan, a motor seat for mounting the motor, and a connection member having a hollow portion provided between the motor seat and the recess, the recess being formed at both side walls thereof with first and second coupling holes into which first and second ends of the center shaft of the blow fan are inserted, the second coupling hole being communicated with the hollow portion of the connection member.

10. The indoor unit as claimed in claim 9, wherein a motor shaft of the motor is coupled to the second end of the center shaft of the blow fan in the hollow portion of the connection member, and the second and third ribs are integrally formed with upper and lower portions of a front surface of the connection member, respectively, so that motor shaft and the second end of the center shaft of the blow fan are supported in the hollow portion of the connection member by the second semi-circular groove of the second fixing plate when the drain pan is coupled to the second and third ribs.

* * * * *